United States Patent [19]

Eickmann

[11] 4,452,127

[45] Jun. 5, 1984

[54] ANTI-FRICTION MEANS IN PIVOT MEANS IN RADIAL PISTON PUMPS, MOTORS OR TRANSMISSIONS

[76] Inventor: Karl Eickmann, 2420 Isshiki, Hayama-machi, Kanagawa-ken, Japan

[21] Appl. No.: 121,356

[22] Filed: Feb. 14, 1980

Related U.S. Application Data

[63] Continuation of Ser. No. 790,822, Apr. 25, 1977, abandoned.

[51] Int. Cl.[3] ..... F01B 31/10

[52] U.S. Cl. ..... 92/159; 91/488

[58] Field of Search ..... 92/158, 159, 160; 91/488

[56] References Cited

U.S. PATENT DOCUMENTS

| | | | |
|---|---|---|---|
| 3,106,138 | 10/1963 | Thoma | 91/488 |
| 3,223,046 | 12/1965 | Eickmann | 91/488 |
| 3,395,948 | 8/1968 | Andrews | 91/488 |
| 3,960,057 | 6/1976 | Kometani et al. | 92/160 |

FOREIGN PATENT DOCUMENTS

| | | | |
|---|---|---|---|
| 2460512 | 6/1976 | Fed. Rep. of Germany | 92/158 |
| 574041 | 3/1976 | Switzerland | 92/158 |
| 983310 | 2/1965 | United Kingdom | 91/488 |

*Primary Examiner*—Paul E. Maslousky

[57] ABSTRACT

A cylindrical piston has a part-cylindrical outcut, which is slotted radially and contains a swingable pivot-member of at least part-cylindrical configuration borne in the outcut and pivoting therein under load. The mentioned outcut is formed partially around an axis which is normal to the longitudinal axis of the mentioned piston and extending through the longitudinal axis of the piston. A plurality of preferably part-annullarily formed grooves for the reception of pressure fluid are provided preferably in said pivot-member in order to lubricate bearing portions of said member between two adjacent grooves or recesses to assure a high pressure lubrication from both ends of the respective bearing portion. Efficiency and life time of said bearing portion is thereby increased and so is the bearing capability.

3 Claims, 8 Drawing Figures

ANTI-FRICTION MEANS IN PIVOT MEANS IN RADIAL PISTON PUMPS, MOTORS OR TRANSMISSIONS

REFERENCE TO RELATED APPLICATION

This is a continuation application of my co-pending patent application Ser. No. 790,822 which was filed on Apr. 25, 1977, now abandoned.

DESCRIPTION OF AND REFERENCE TO FORMER ART

Certain pistons and piston shoes in radial piston devices, such as pumps, motors, compressors, transmissions which are characterized therein, that the piston has a radially outwardly or inwardly slotted bore and a pivot-bar portion of part-cylindrical configuration pivotably or swingably borne therein. Said pivot-bar portion is a portion of a piston shoe, which is inserted between said piston and an actuator means to actuate the piston stroke. The slot of said bore is narrower than the diameter of said bore. The piston shoe has an outer portion and a medial portion between said outer portion and said pivot bar portion. The said medial portion is narrower than said slot of said slotted bore. Thereby it is assured, that the piston shoe can pivot in a limited extend with its pivot-bar portion in said slotted bore and thereby the piston shoe can pivot relatively to said piston. Parts of the walls of the slotted bore embrace neighbouring portions of the pivot-bar portion in the preferred known art and thereby the piston shoe is fastened to the piston. In other samples the piston shoe may just be laid onto the piston without embracement of portions thereof on each other. Those piston-piston-shoe assemblies are known from my basic U.S. Pat. No. 3,223,046 and so also from improvement patents, like U.S. Pat. Nos. 3,225,706; 3,304,883 or others.

In the mentioned former art it is also already disclosed, that recesses are provided between the pivot-portion and the piston and passages lead to said recesses in order to force-lubricate the bearing of said pivot-bar portion in said piston.

REFERENCE TO CO-PENDING APPLICATION

A very considerable improvement of the mentioned art is obtained in my U.S. patent application Ser. No. 802,231 of June 1, 1977; now U.S. Pat. No. 4,206,690 and also in Ser. No. 528,346 of Nov. 29, 1974, which continued in application Ser. No. 765,221 of Feb. 3, 1977; which issued as U.S. Pat. No. 4,193,336 on Mar. 18, 1980; namely in FIGS. 19 and 22 thereof. In these and other similar patent applications in USA and other countries, the pivot-bar portion has rounded ends parallel to the outer diameter of the piston and the sealing portions of the pivot-bar portion outwards of the fluid pressure pocket have about equal extension whereby a maximum of cross-sectional area of said fluid pressure pocket or lubrication recess is obtained.

BACKGROUND OF THE INVENTION

The above mentioned former art has operated for more than a decade from its origin with high reliability and performance. I have found however, that the efficiencies can be further improved and thereby the life time can be elongated and the pressure and rotary velocity in machines which employ the pivot-portion of a piston shoe in a slotted bore of a piston can still further be improved. I have also found, that such improvement is necessary in order to apply such machines for ever higher pressures, powers and velocities in from time to time advancing applications with requirements to higher power and efficiency; like aircraft, vehicles, construction machinery, machine tools and like.

SUMMARY OF THE INVENTION

It has been found, that the above mentioned former art applies practically a single fluid pressure pocket between the bearing faces of the pivot-bar portion and the piston.

The used fluid pressure pocket provides an effective lubrication and also a very considerable reduction of the relative load between the piston and pivot bar portion, because the forces of pressure in fluid in the balancing recess or fluid pressure pocket acts in opposite direction against the piston and the pivot-bar portion, whereby it trends to press them away from each other. Thereby reducing the load of the piston onto the piston-shoe. This reduction of load is as higher as bigger the cross-sectional area of the fluid pressure pocket is.

It has now been found in accordance with this invention, that the cross-sectional area of the said fluid pressure pocket can not be extended unlimited. A sealing portion must remain on each end of the fluid pressure pocket. If this sealing portion becomes too thin or too short, the relative load on the sealing portions becomes so high, that the sealing portions deform.

It has further been found in accordance with this invention, that high power devices need a relatively large piston stroke per given diameter of the device, which in turn requires a relatively wide pivoting angle. This wider pivot-angle results in a relatively high relative velocity between the neighbouring bearing faces and thereby in the sum in a high friction between the pivot-bar member and the wall of the slotted bore in the piston.

Certainly this matter has been given some attention in the earlier patents of applicant. However, the disastrous effect of the said friction at high velocities and pressure has never been found out in its entire extent.

New researches in the matter have now in accordance with this invention discovered, that the said friction can become very high at big pivot-angles, velocities and pressures.

Also by this invention one of the reasons of said friction has been further discovered. This is, that in the seal portions between the sealing faces a pressure gradient appears. Such pressure gradients from high pressure down to sorrounding low pressure are generally known. However in the case of the narrow seal portions between pivot bar portion and piston's slotted bore-wall, the forces, which press the piston and piston-bar together are so high, that almost no fluid pressure enters into the seal portion between the sealing faces. That results in an almost dry friction and wear off of the seal faces.

Since this fact is now discovered by this invention, the means to overcome this drawback are also discovered in this invention.

It is therefore the main object of this invention to prevent extensive dry friction between the seal portions and at the same time to provide a larger bearing face area between piston shoe-pivot bar and the piston's cross-bore wall.

Another object of the invention is to provide fully pressure lubricated bearing face portions between pivot-bar portion and The objects of the invention are materialized by the provision of a plurality of narrow recesses and fluid pressure passages to them between the said walls and portions in order to establish a plurality of bearing face portions, which are lubricated under force from both ends and which bear the pivot-bar portion on the wall of the slotted bore in the piston, whereby they eliminate too narrow a clearance in the sealing end portions and at the same time narrow the bearing load in the sealing portions on the ends of the pivot-bar portion.

The provisions of this invention narrow the relative load on the bearing faces and sealing faces between the pivot-portion of the piston shoe and the piston very extensively and thereby provide a high efficiency at pivot move and extend the life time of the piston and piston shoe very considerably. Thereby in turn the efficiency and life time of the pump, motor, compressor, transmission or pivot-bearing becomes increased in a surprisingly high degree.

DESCRIPTION OF THE PREFERRED EMBODIMENTS

Figure 1:
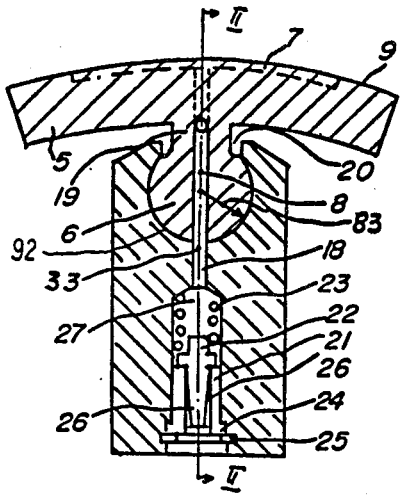
FIG. 1 is a longitudinal sectional view through an embodiment of a piston-piston shoe assembly of the invention.
Figure 2:
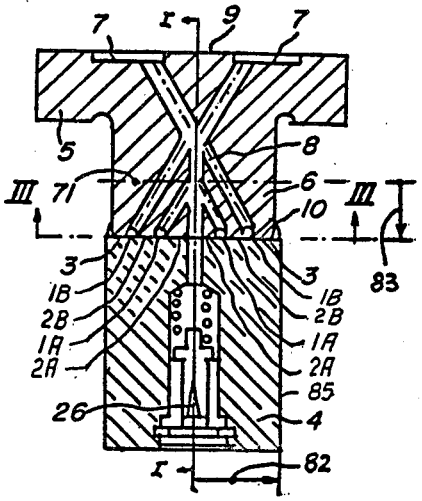
FIG. 2 is a cross-sectional view through FIG. 1 along line II—II.
Figure 3:
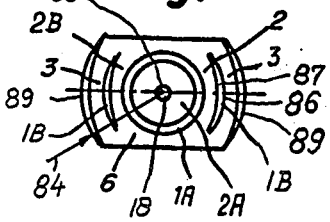
FIG. 3 is a view onto the bottom of the pivot bar portion of FIG. 2 along the line III—III.

In FIGS. 1 to 3 numbers 4 show the piston; 5 show the piston shoe; 6 show the pivot bar portion; 7 show balancing recesses in the outer face of the piston shoe; 8 show communication passages in the piston shoe; 18 show a communication passage in the piston and 9 show the outer face of the piston shoe of the former art. Insofar the respective means of the inventional embodiment are equal to those of the known former art. Pivot-bar portion 6 is inserted into and borne in the known slotted bore of piston 4. Between the outer portion 5 of the piston shoe and the innermost pivot-bar portion 6 of the piston shoe is the known narrow medial portion or neck 19 of the piston shoe. It is able to swing or pivot in the slot 20, which extends from the slotted bore to one end of the piston 4. Referential numbers 46 and 44 are similar known parts of the former art in FIG. 7.

Figure 8:
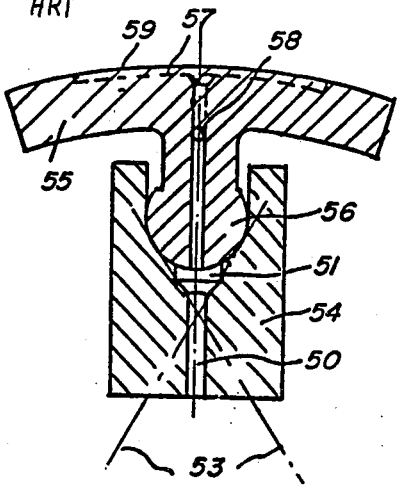
Fig. 8 PRIOR ART
FIG. 8 shows a longitudinal sectional view through another embodiment of the former art for explanatory purposes.

For the best understanding of the invention 3 will now discuss FIG. 8. FIG. 8 shows a conventional piston with a part-spherical bearing bed wherein a piston shoe foot 56 which forms a complementary part-spherical face-portion is pivotably borne. The piston is shown by 54 with the common passage 50. Piston shoe 55 has passage 58 and outer balancing pocket 57 in outer face 59. Since friction was appearing between the piston's bed and pivot foot 56 it was attempted to provide a fluidpressure balancing pocket 51 between piston 54 and pivot portion 56. This reduced the load between said both parts, but at same time it pressed the portion 56 by a mean tangent 55 almost like a cone into the spherically formed taper-cone. That led to such high friction, that the piston shoe 55 almost sticked in said piston 54 by said taper-cone action of medial tangents 53. Thus, instead of reducing friction between the piston and piston shoe the friction became actually increased. The arrangement of FIG. 8 of the known art is therefore an error.

Figure 6:
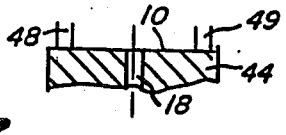
FIG. 6 demonstrates the sealing end portions of the former art.
Figure 7:
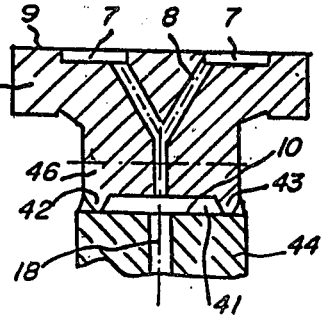
Fig. 7 PRIOR ART
FIG. 7 shows a portion of the piston-piston-shoe assembly of the former art.

With this new knowledge I can now discuss FIG. 7 of applicant's patents of the known art. Piston 44 carries in its slotted bore the pivot-bar portion 46. The bottom of the slotted bore is cited by numeral 10 in FIGS. 2,3,5,6, and 7. The other numbers as far as they are similar to FIGS. 1 and 2 are similar means in FIG. 7. The pivot bar portion has the extended fluid pressure balancing pocket 41. On the ends thereof the sealing end portions 43 are provided and borne in the slotted-bore bed of piston 44. Pressurized fluid enters from the cylinder through passage 18 into the respective balancing pocket, for example 41, of FIGS. 1,27 and into the passages 8 in the piston shoe 5, as known from the former art.

Figure 4:
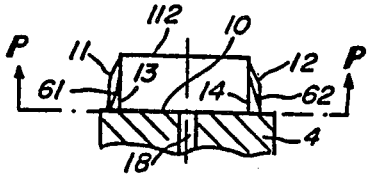
FIG. 4 demonstrates the pressure in fluid on the bottom of the pivot-bar portion.

This invention now discovers, that, as shown in FIG. 4, the pressure "p" rises between the bed face 10 and the faces of the end seal portions 42 and 43 along the lines 61 and 62 of FIG. 4 to a maximum pressure 112. All this schematized pressure acts to reduce the load between piston and piston shoe. This invention now further discovered, that the courved pressure gradients 61 and 62 allowed only very little lubrication fluid to enter between the faces 10 and faces of seal portions 42 and 43. Thus, at high pressures and speeds, the sealing areas got mixed-or dry friction between parts 42,43 and 10. The friction became as dryer as more the distance from the axis of the piston 44 was. The result of this almost dry friction was an increase in friction, a wear off and a reduction of efficiency and life time. The friction losses and life time losses became at high pressures in fluid and at high working speeds so considerable, that the high pressure-high speed devices could not any more be considered as most effective devices.

The sizes of the seal portions in the direction parallel to the axis 71 of the pivot-bar-portion is schematically demonstrated by referential numbers 48 and 49 in FIG. 6.

The in detail described drawbacks of the known piston-piston-shoe assembly of applicant's patents are overcome by this invention. This is materialized by the provision of a plurality of balancing fluid pressure pocket recesses and the provision of bearing portions between those recesses on the pivot-bar portion 6. This is demonstrated in FIG. 2. In FIG. 3, where different configurations and locations of recesses and of portions are visible, the different fluid pressure pocket recesses are shown as 1A and 1B; while the different bearing portions are shown by 2A and 2B. One or more, but at least one, communication passage, for example bores, 8, are provided in order to communicate each fluid pressure pocket recess with communication passage 18 in piston 4. The simplest embodiment is, to provide only one annular fluid pressure pocket recess 1A as shown in FIG. 3, whereby at least one bearing portion 2A is established between central passage 33 (FIGS. 3 and 1) and recess 1A. Thus, from the innermost recess 1A and medial recess 33 or central passage or bore 33 fluid is forced under pressure from both ends into the clearance between the respective portions of face 10 of the wall of the slotted-bore and the respective bearing portions 2A of pivot-bar portion 6. Thereby the respective bearing portion 2A almost floats on a pressurized fluid film almost equal to the maximum pressure in the fluid.

For bigger sized piston shoe and piston assemblies it is suitable, to provide a plurality of fluid pressure pocket recesses. For example, recesses 1A and 1B. That is shown in FIG. 2 and also in FIG. 3. FIG. 3 is a view from bottom onto the pivot bar portion 6 of FIG. 2. It also shows the axial ends of portion 6 as formed by ends 89 by a third radius 84 around the fourth axis 88 of piston shoe 5,6. Thus, we see one central bore or recess 33 and four balancing recess pockets in FIG. 2 and we see four bearing portions between them in FIG. 2. The recesses 1B are preferred to be formed with respective radii around the first axis 81 or around the fourth axis 88 of the respective piston or piston shoe 4 or 5 and the recesses 1B may have walls which limit the extensions of the recesses to form thereby convex and concave surfaces 86,87 of respective radii around the first axis 81 of piston 4 or of respective radii around the fourth axis 88 of the piston shoe 5. When the recesses 1B are provided in the piston shoe as shown in FIG. 3, they are formed with the respective radii around the respective fourth axis 88 of the piston shoe. A portion of the radial outer face of pivot member 6 forms the bearing face 92 for slide along bed 10 and the recesses 1 may be extended through the bearing face 92 into pivot member 6.

When FIG. 2 is viewed in combination with FIG. 3, it will become apparent however, that the recesses 1A of FIG. 2 form actually a single recess 1A and the bearing portions 2A form actually a single bearing portion 2B. Thus, while four recesses and bearing portions appear to the eye in FIG. 2, there are actually only three recesses and bearing portions in the arrangement, namely the inner single recess 1A and the two outer recesses 1B and the inner single bearing portion 2A and the two outer bearing portions 2B. The outer sealing portions 3 are also seen in FIGS. 2 and 3. According to the invention, there is now a difference in function between the bearing portions and the sealing portions 3. The bearing portions are force-lubricated from two sides or ends and are therefore loaded with high pressure fluid. That enables them to carry out the function of bearing under low friction. THe sealing end portions 3 have the different function of sealing and of bearing. Since however, the main load is borne by the bearing portions, the fluid films below them act also to reduce the bearing load of the pivot-bar portion 6 a little, relatively to the bottom of bed 10, so that a little less load appears also between the end portions 3 and the bed face 10. This little reduction of relative load on the sealing end portions 3 brings the new effect, that the pressure gradient changes from lines 61,62 in FIG. 4 to pressure gradients 11 and 12 of a more outwardly directed form. That means, that more pressure fluid enters the clearance below the sealing end portions 3, thereby lubricates them better, carries more load and reduces friction better, than in the assembly of FIG. 7 of the former art of inventor's earlier patents. Regarding FIG. 3 it may be noted, that two of the four pockets 1 in FIG. 4 may also be considered as a single pocket, namely as the circular recess 1 of FIG. 3.

Figure 5:
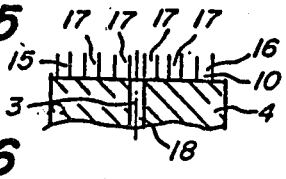
FIG. 5 demonstrates the sealing end portions and the force-lubricated medial bearing portions of FIGS. 1, 2 and 3.

FIG. 5 demonstrates the sizes of end portions 15,16 and of bearing portions 17 schematically along bottom face 10 of piston 4, according to FIG.2. Between sealing end areas 15 and 16 and bearing face areas 17 are the recesses 1,3 of the invention. It is suitable, to make central recess 3 much smaller, than the fluid pressure pockets 41 of the former art in order to obtain as much bearing area 17 as possible.

The lines 11,112,12 in FIG. 4 demonstrate the high fluid pressure bearing pressure and thereby bearing capacity of the embodiment of FIGS. 1 to 3 of the invention. This is higher, than the capacity of lines 61,112,62 of FIG. 4 of the assembly of FIG. 7 of the cited former art.

Still more effective is the increase in lifetime and the reduction of load on portions of the walls of pivot bar portion 6 and of piston's face 10.

Areas 48 plus 49 of former art may have been about 10 percent of the cross-sectional area of the piston in highest class devices of FIG. 7. But bearing areas 17 of FIG. 5 depending on FIG. 2 may be 40 percent of the cross-sectional area of the piston 4,44. End face areas 15,16 may be the same as 48,49. Thus, the load exerted onto the contacting faces in the former art was:

$$(D^2pi/4)\ p \text{ minus } 61,112,62/48+49=\text{about} \quad (1)$$

with areas 48+49=about 0,1 ($D^2pi/4$) but the load excerted onto the contacting faces in the invention is only:

$$(D^2pi/4)\ p \text{ minus } 11,112,12/15+16+\text{sum of } 17 \quad (2)$$

with areas 15+16+sum of 17=about 0,5($D^2pi/4$). Or, in other words: The load excerted onto the contacting faces of the invention can be about 5 times less, than in the former at of applicant's former patents. That increases the lifetime multifold and increases the efficiency of the devices of the invention greatly.

It should also be noted, that the centre line of the bottom of the cross bore, namely number 10, is exactly normal to the direction of load. Thus, there is no tapered sticking under load as in FIG. 8 of the former art. This elimination of sticking by pressing together of faces in a cone-like structure gives also a very high efficiency and life time to the device of the invention.

Thus, in summary, the invention provides the most extended contact faces, the most extended fluid pressure balancing area and action, the most efficient sealing end face portions, the best direction of bearing face power, most less friction and most efficiency and life time.

While the specific and prefered embodiment is described as a piston and a pivote bar portion of a piston shoe, it is quite sure, that the invention is also applicable to any body having a bearing-bed, face or bore preferably normal to the axis of said body in said body and a part-cylindrical or cylindrical pivot-body borne in said bed, face or bore. Provided, that communication passages are provided in said body and fluid under pressure is entered into the recesses of the invention in said body or bodies.

In FIGS. 1 and 2 are restriction means shown for the restriction of flow through passage 18. This is suitable to press the piston and shoe assembly out of the cylinder under force of pressure in fluid. Restriction housing 21 may be provided with a bore and/or seat for the reception of a valve member 22. Valve member 22 may be pressed into closing position by spring means 23 in piston 4. Valve member 24 may be provided with gradially increasing recesses 26 for flow of fluid through them in the more or less opened position. The opening of them occurs, when fluid under pressure acts from the bottom against the said valve member 22. Valve housing 21 may have a shoulder 24 and fastened therewith and with a retaining means 25 in a respective seat in piston 4. This assembly is especially suitable for high speed pumps and also for motors.

The invention has so far been described in general language. It has been found however, that such terms, which were occasionally used, as "cross-bore" or "slotted bore" are sometimes misunderstood or otherwise interpreted than as desired.

The invention will therefore in the following be defined in strict mathematical or geometrical terms. To understand them also by those who are not accustomed to such pure geometrical language it may be noted, that; in the following:

the Piston 4,44 is called: a first body;
the piston shoe 5 is called: a second body;
the pivot-portion 6 is called: a member;
the piston's longitudinal axis 81 is called: a first axis;
the axis 71 through the slotted bore of the piston is called: a second axis;
the axis 71 through the pivot-bar 6 which is equally located with the second axis through the piston is called: a third axis;
the axis 88 through bore 8 of the piston shoe is called: a fourth axis;
the radii 83 of the slotted bore and of the pivot portion or member are called first radii;
the radius 82 around the first axis of the piston is called: a second radius;
the face 10 of the slotted bore in the piston is called: a face;
the slotted bore in the piston is called: an outcut; including a bearing bed;
the face of the outcut is called: a face or a bearing bed;
the outer face of the pivot portion is called: a bearing face; and,
the pivot portion is consequentely also called: a member of the second body.

The substantially sickle shaped recesses, as far as they are located between the bearing face portions 2 and 3 are boardered by substantially concave and convex surfaces 86,87 of radii around the fourth axis 88.

I claim:

1. An assembly of at least two bodies including a first body and a second body with said bodies being pressed together under a load;

wherein said first body has a first axis and a second axis;
wherein said second axis is normal to said first axis and extending through said first axis and through said first body;
wherein said second body includes an at least partially cylindrical member;
wherein said second body has a third axis coinciding with said second axis of said first body;
wherein said member extends around said third axis;
wherein said first body has an at least partially cylindrical outcut for the reception of said member of said second body;
wherein said member and said outcut have faces formed by substantially equal first radii around said second and third axes and wherein one of said faces forms a bearing bed in said first body while the other of said faces forms a bearing face on said member of said second body;
wherein said member is borne in said outcut and said load is acting in a direction substantially parallel to said first axis and normal to said second and third axes;
wherein said member of said second body is able to move in said outcut of said first body and around said second and third axes;
wherein said bearing face slides along said bearing bed when said member moves in said outcut relatively to said first body;
wherein at least two recesses are provided in at least one of said bodies and connected to said bearing bed and to said bearing face;
wherein said recesses constitute fluid pressure pockets;
wherein at least one fluid pressure passage extends through at least one of said bodies to said recesses;
wherein at least one portion of said bed and at least one portion of said face are located between said recesses and lubricated from both ends by fluid from said at least two recesses;
wherein said portions include straight lines and adjacend face-portions extending substantially normal to the direction of said load of one of said bodies relatively to the other of said bodies, and wherein said recesses are distanced from said first axis in a direction parallel to said second and third axes.

2. An assembly of at least two bodies, wherein one of said bodies has one at least partially cylindrical portion extending around an axis which is normal to an axis of the other body;
wherein the other body of said bodies has an at least partially cylindrical bore for the reception of said portion of said one body;
wherein the wall of said bore forms a bearing bed;
wherein the outer face of said portion forms a bearing face;
wherein said portion is moveably borne in said bore;
wherein said bearing face slides along said bearing bed when said portion ion moves in said bore relatively to said other body;
wherein at least two recesses are provided in at least one of said bodies and connected to said bearing bed and to said bearing face;
wherein said recesses constitute fluid pressure pockets;
wherein at least one fluid pressure passage extends through at least one of said bodies to said recesses and,
wherein at least one portion of said bed and at least one portion of said face are located between said recesses and are lubricated from both ends by fluid from said at least two recesses.

3. An assembly of at least two bodies, wherein one of said bodies has an at least partially cylindrical portion extending around an axis normal to an axis of the other body;
wherein the other body of said bodies has close to one of its ends an at least partially cylindrical bore for the reception of said portion of said one body;
wherein a slot extends from said bore through said other body to said one end of said other body;
wherein said slot is narrower than the diameter of said bore;

wherein the wall of said bore formes a bearing bed;

wherein said one body has an extension which extends radially from said portion;

wherein said extension is narrower than said slot;

wherein the outer face of said portion forms a bearing face;

wherein said portion is pivotably borne in said bore and and said extension extends through said slot;

wherein said bearing face slides along said bearing bed and said extension moves in said slot when said portion pivots in said bore relatively to said other body;

wherein at least two recesses are provided in at least one of said bodies and connected to said bearing bed and to said bearing face;

wherein said recesses constitute fluid pressure pockets;

wherein at least one fluid pressure passage extends through at least one of said bodies to said recesses, and;

wherein at least one portion of said bed and one portion of said face are located between said recesses and lubricated from both ends by fluid of said at least two recesses.

* * * * *